US010508839B2

(12) United States Patent
Feller et al.

(10) Patent No.: US 10,508,839 B2
(45) Date of Patent: Dec. 17, 2019

(54) REFRIGERANT COMPRESSOR WITH LUBRICANT DISTRIBUTION UNIT HAVING FILTER HOLDING CHAMBER WITH FILTER BODY THEREIN

(71) Applicant: BITZER Kühlmaschinenbau GmbH, Sindelfingen (DE)

(72) Inventors: Klaus Feller, Herrenberg (DE); Roni Lörch, Neuenbürg (DE); Tihomir Mikulic, Holzgerlingen (DE)

(73) Assignee: BITZER Kühlmaschinenbau GmbH, Sindelfingen (DE)

( * ) Notice: Subject to any disclaimer, the term of this patent is extended or adjusted under 35 U.S.C. 154(b) by 0 days.

(21) Appl. No.: 14/969,962

(22) Filed: Dec. 15, 2015

(65) Prior Publication Data

US 2016/0097572 A1 Apr. 7, 2016

Related U.S. Application Data

(63) Continuation of application No. PCT/EP2014/062729, filed on Jun. 17, 2014.

(30) Foreign Application Priority Data

Jun. 18, 2013 (DE) ..... 10 2013 106 344

(51) Int. Cl.
*F03C 2/00* (2006.01)
*F03C 4/00* (2006.01)
(Continued)

(52) U.S. Cl.
CPC ..... *F25B 31/002* (2013.01); *F04C 18/16* (2013.01); *F04C 29/026* (2013.01);
(Continued)

(58) Field of Classification Search
CPC .... F04C 18/16; F04C 23/008; F04C 29/0092; F04C 29/026; F04C 29/028;
(Continued)

(56) References Cited

U.S. PATENT DOCUMENTS 3,101,171 A * 8/1963 Fraser ..... F04C 29/0092 418/47
4,153,392 A 5/1979 Elson et al.
(Continued)

FOREIGN PATENT DOCUMENTS

DE 3637229 A1 6/1987
DE 4211399 A1 10/1993
(Continued)

OTHER PUBLICATIONS

Definition of Strainer by using Merriam Webster—https://www.merriam-webster.com/dictionary/strainer—Feb. 27, 2018.*

*Primary Examiner* — Theresa Trieu
(74) *Attorney, Agent, or Firm* — Reinhart Boerner Van Deuren P.C.

(57) ABSTRACT

A refrigerant compressor particularly a rotary screw compressor comprising a compressor housing, a compressor element which is driven by a drive and is arranged in said compressor housing, at least one bearing unit for at least one element of the drive which comprises at least one bearing housing and at least one roller bearing that is arranged in the bearing housing. Lubricant is supplied by a lubricant distribution system to the bearing housing and a lubricant dispensing unit which comprises a filter holding chamber and a filter body that is arranged in the filter holding chamber is associated with the bearing housing.

14 Claims, 10 Drawing Sheets

(51) Int. Cl.

| | |
|---|---|
| ***F04C 15/00*** | (2006.01) |
| ***F04C 2/00*** | (2006.01) |
| ***F25B 31/00*** | (2006.01) |
| ***F04C 29/02*** | (2006.01) |
| ***F04C 18/16*** | (2006.01) |
| ***F25B 31/02*** | (2006.01) |
| *F04C 29/00* | (2006.01) |
| *F04C 23/00* | (2006.01) |

(52) U.S. Cl.
CPC ..... *F04C 29/028* (2013.01); *F25B 31/026* (2013.01); *F04C 23/008* (2013.01); *F04C 29/0092* (2013.01); *F04C 2240/50* (2013.01); *F04C 2240/52* (2013.01)

(58) Field of Classification Search
CPC ..... F04C 2240/50; F04C 2240/52; F25B 31/026; F25B 31/002

USPC ..... 418/47, 89, 97–99, 201.1; 184/6.16–6.17; 417/410.3, 410.4

See application file for complete search history.

(56) References Cited

U.S. PATENT DOCUMENTS

| | | | | |
|---|---|---|---|---|
| 4,560,329 | A * | 12/1985 | Hirahara | F04C 29/0092 418/47 |
| 4,770,615 | A * | 9/1988 | Fujiwara | F04C 29/122 418/15 |
| 5,382,099 | A | 1/1995 | Bauer et al. | |
| 6,129,531 | A | 10/2000 | Elson et al. | |
| 6,488,488 | B2 * | 12/2002 | Achtelik | F04C 29/0092 418/47 |
| 7,690,482 | B2 * | 4/2010 | Shoulders | F04C 29/026 418/97 |
| 8,146,712 | B2 * | 4/2012 | Vincent | C10M 175/0091 184/6.16 |
| 8,870,555 | B2 | 10/2014 | Feller et al. | |
| 2005/0186095 | A1 | 8/2005 | Zinsmeyer et al. | |
| 2007/0163840 | A1 | 7/2007 | Sekiya et al. | |
| 2014/0011622 | A1 | 1/2014 | Sone et al. | |

FOREIGN PATENT DOCUMENTS

| | | | | |
|---|---|---|---|---|
| DE | 19634689 | A1 | 3/1998 | |
| DE | 102006033555 | A1 | 1/2008 | |
| DE | 102010002649 | A1 | 9/2011 | |
| DE | 11 2012 001375 | | 12/2013 | |
| EP | 0646701 | A1 | 4/1995 | |
| JP | 60178990 | A * | 9/1985 | F04C 29/092 |
| WO | WO 2006/085865 | A2 | 8/2006 | |

* cited by examiner

REFRIGERANT COMPRESSOR WITH LUBRICANT DISTRIBUTION UNIT HAVING FILTER HOLDING CHAMBER WITH FILTER BODY THEREIN

CROSS-REFERENCE TO RELATED PATENT APPLICATION

This application is a continuation of International application No. PCT/EP2014/062729 filed on Jun. 17, 2014.

This patent application claims the benefit of International application No. PCT/EP2014/062729 of Jun. 17, 2014 and German application No. 10 2013 106 344.6 of Jun. 18, 2013, the teachings and disclosure of which are hereby incorporated in their entirety by reference thereto.

BACKGROUND OF THE INVENTION

The invention relates to a refrigerant compressor, particularly a rotary screw compressor, comprising a compressor housing, a compressor element which is arranged in the compressor housing and driven by a drive, at least one bearing unit for at least one element of the drive which comprises at least one bearing housing and at least one roller bearing that is arranged in the bearing housing.

Refrigerant compressors of this type are known from the state of the art.

In the case of these refrigerant compressors, there is a problem that the roller bearing in the bearing housing should be optimally lubricated on the one hand, and that the supply of too much lubricant leads in turn to power losses in the compressor on the other.

Consequently, the object of the invention is to improve a refrigerant compressor of the type described above in such a manner that an optimal supply of lubricant to the roller bearing in the bearing housing is possible.

SUMMARY OF THE INVENTION

In accordance with the invention, this object is achieved in a refrigerant compressor of the type described above in that lubricant is supplied to the bearing housing by a lubricant distribution system, in that a lubricant dispensing unit comprising a filter holding chamber is associated with the bearing housing, and in that a filter body is arranged in the filter holding chamber.

The advantage of the solution in accordance with the invention is to be seen in the fact that it is then possible to meter out the stream of lubricant flowing through the filter body onto the roller bearing in the bearing housing and to simultaneously reduce the probability of damage to the roller bearing by filtering the stream of lubricant once more by means of the filter body immediately before it enters the roller bearing so that particles floating around in the lubricant distribution system are also filtered out and cannot enter the roller bearing.

In connection with the preceding explanation of the individual components of the lubricant dispensing unit, no other indications have been given as to the construction thereof in regard to elements additional to the filter body holder and the filter body.

In particular, it was assumed that the filter body undertakes the function of flow control for the stream of lubricant. In the simplest case thereby, provision is made for an inlet channel extending from the filter holding chamber to a lubricant chamber adjoining the roller bearing to be connected to the filter holding chamber.

This inlet channel does not have to undertake any additional functions whatsoever in the simplest case.

Another advantageous solution however envisages that the lubricant dispensing unit comprise a throttle boring which is arranged between the filter holding chamber and a lubricant chamber adjoining the roller bearing and which, in addition to the filter body, exerts a restriction effect on the stream of lubricant being supplied to the lubricant chamber so that collectively the restriction effect of the lubricant dispensing unit results from the filter body and the throttle boring.

A throttle boring of this type has the advantage that the restriction effect produced thereby complements the restriction effect of the filter body and can thus ensure a reliable lubricant distribution system for the roller bearing in the bearing housing under different operating conditions.

In particular, the filter body not only has a restriction effect on the stream of lubricant in this case, but the filter body also permits the throttle boring to be implemented in the form of a very thin fine boring without the risk of this throttle boring becoming clogged due to particles that are being carried along by the lubricant distribution system.

In regard to the arrangement of the lubricant dispensing unit, no particular details have so far been given.

In principle, it would be conceivable for the lubricant dispensing unit to be provided before the bearing housing in the lubricant distribution system.

One expedient solution however envisages that the lubricant dispensing unit be integrated into the bearing housing.

A particularly appropriate solution envisages that the bearing housing comprise a housing element in which the lubricant dispensing unit is arranged, especially integrated therein.

Thereby, the housing element could be a housing section accommodating the roller bearing for example.

Another advantageous solution envisages however that the housing element which accommodates the lubricant dispensing unit be in the form of a bearing housing cover of the bearing housing.

A further advantageous solution envisages that the housing element be in the form of a bearing housing ring of the bearing housing.

In particular, the lubricant dispensing unit is integrated into the bearing housing cover in this case.

In regard to the guidance of the lubricant in the bearing housing, no particular details have so far been given.

Thus, one solution envisages that the lubricant dispensing unit supply the lubricant to a lubricant chamber of the bearing housing from which the lubricant can then enter the roller bearing.

In the simplest case, provision is made for the lubricant dispensing unit to supply the lubricant to the lubricant chamber, whereby the lubricant collects at the lowest point of the lubricant chamber and then enters the roller bearing.

Another advantageous solution envisages that the lubricant dispensing unit be provided with a nozzle boring which is located after the filter holding chamber and produces a jet of lubricant directed at the roller bearing in the bearing housing and thus applies the lubricant to the rolling members of the roller bearing in a targeted manner for example.

In this case, the filter body being used in accordance with the invention has a further advantage, namely, to the effect that the nozzle boring can be in the form of a very fine boring and, due to the additional filter effect of the filter body, clogging of the nozzle boring by particles being carried along in the lubricant distribution system is prevented.

A particularly expedient solution envisages that the throttle boring of the lubricant dispensing unit be arranged in such a manner that it works as a jet boring.

In the case of the solution in accordance with the invention, the filter body can be formed from various materials.

One possibility envisages that the filter body be formed of a sintered metal whereby, for this purpose, bronze or stainless steel can be used as the material.

Another possibility envisages that the filter body be formed of a refrigerant-neutral and lubricant-neutral synthetic material whereby in particular, a sintered porous synthetic material, and also a compacted or baked granulated synthetic material for example, can be used.

In regard to the compressor element and the drive, no particular details have so far been given.

Thus, the compressor element could be a piston or a scroll element having an appropriately constructed drive therefor.

One advantageous solution envisages that the compressor element be a screw rotor of a rotary screw compressor and that the drive comprise, as elements, sections of shaft for mounting the screw rotor and of these, at least one is mounted in accordance with the present invention.

In particular, the sections of shaft arranged on the suction-side and/or those arranged on the high pressure side are mounted in accordance with the present invention.

Further features and advantages of the invention form the subject matter of the following description as well as the graphical illustration of some exemplary embodiments.

DETAILED DESCRIPTION OF THE INVENTION

Figure 1:
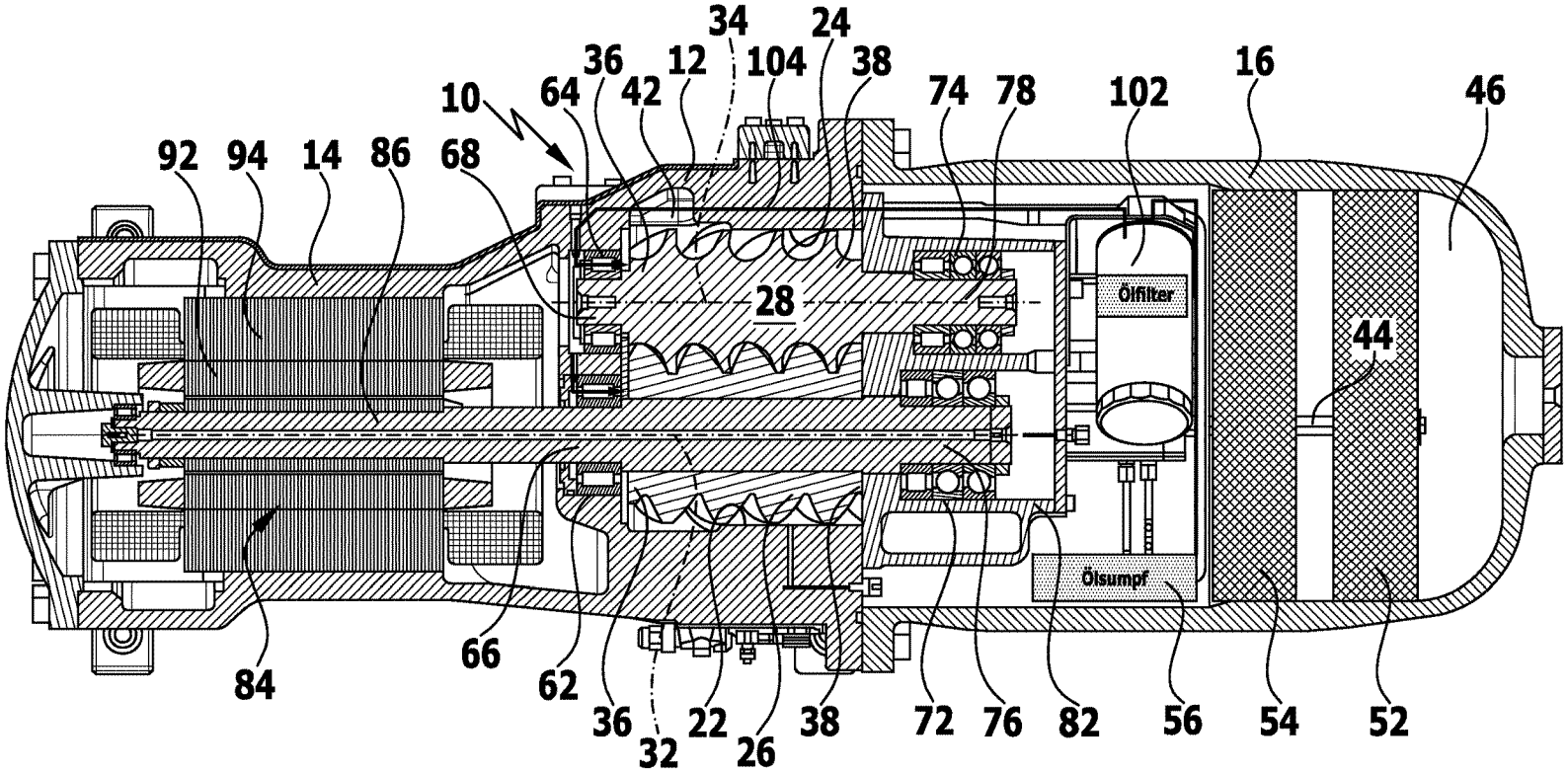
FIG. 1 shows a schematic longitudinal section through a first exemplary embodiment of a refrigerant compressor in accordance with the invention.
Figure 2:
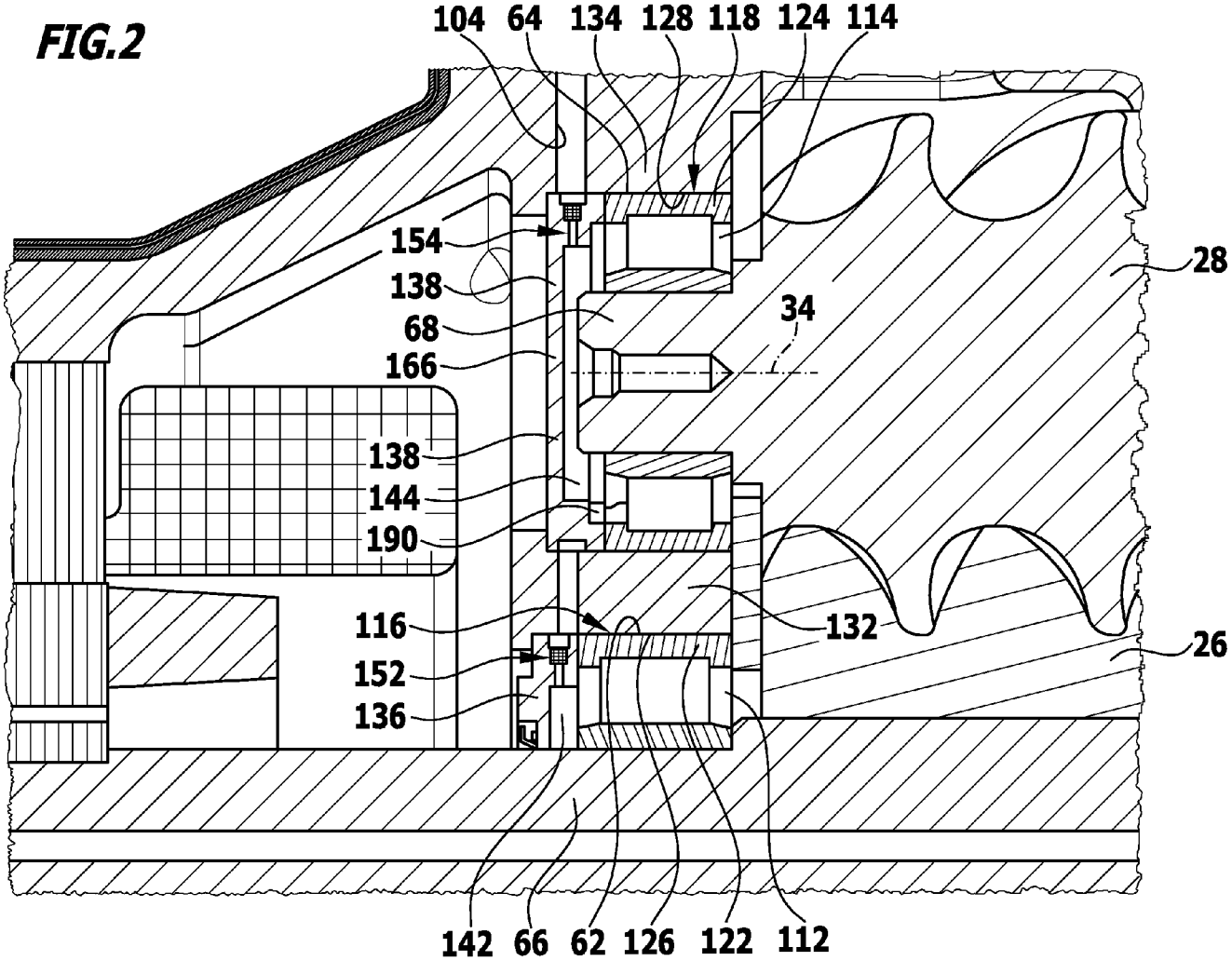
FIG. 2 an enlarged sectional view corresponding to FIG. 1 in the region of bearing units arranged on the suction-side.

An exemplary embodiment of a refrigerant compressor in accordance with the invention which is illustrated in FIG. 1 comprises an overall housing 10 which comprises a compressor housing 12, a motor housing 14 arranged on a side of the compressor housing 12 and a pressure housing 16.

Seating borings 22, 24 are provided in the compressor housing 12 for screw rotors 26 and 28 which are mounted in the seating borings 22, 24 such as to be rotatable about respective rotational axes 32, 34.

Hereby, the screw rotors 26, 28 extend from a low pressure side 36 to a high pressure side 38 wherein a refrigerant supply channel 42 is associated with the low pressure side 36, whereas, on the high pressure side 38, provision is made for a high pressure outlet which is not illustrated in FIG. 1 and from which the compressed refrigerant enters the pressure housing 16 via an outflow channel 44, namely, entering an end side chamber 46 from which it then passes through two lubricant separators 52, 54 that are arranged in the pressure housing 16 and by means of which the lubricant is separated from the compressed refrigerant and supplied to an oil sump 56 disposed in the pressure housing 16, whereby moreover, the refrigerant compressed at high pressure emerges from the pressure housing 16 through a not illustrated high pressure outlet.

The mounting of the screw rotors 26, 28 is effected in the region of the low pressure side 36 of the screw rotors 26, 28 by means of bearing units 62, 64 which are arranged in the compressor housing and serve to hold bearing shaft sections 66, 68 of the screw rotors 26, 28.

Furthermore, mounting of the screw rotors 26, 28 is effected in the region of their high pressure side by means of bearing units 72, 74 which likewise serve to hold shaft sections 76, 78 of the screw rotors 26, 28.

Hereby, the bearing units 72, 74 are arranged in a high-pressure-side bearing housing 82 which is firmly attached to the compressor housing 12 and in connection with the compressor housing 12 projects into the pressure housing 16.

The drive for the screw rotors 26, 28 is provided by a drive motor 84 which is arranged in the motor housing 14 whilst the motor shaft 86 thereof extends, in one piece manner for example, into the bearing shaft section 66 and carries a rotor 92 which is likewise rotatable coaxially with respect to the rotational axis 32 of the bearing shaft section 66 in this exemplary embodiment.

Furthermore, the driver motor 84 comprises a stator 94, which is arranged in non-rotary manner in the motor housing 14.

In the illustrated exemplary embodiment of the refrigerant compressor in accordance with the invention, the sucked-in refrigerant flows firstly through the motor housing 14 in order to cool the rotor 92 and the stator 94 for example, and then passes over into the refrigerant supply channel 42 which supplies the sucked-in refrigerant to the low pressure side 36 of the screw rotors 26, 28.

For the purposes of lubricating all of the bearing units 62, 64 and 72, 74 as well as the screw rotors 26, 28 in the seating borings 22, 24, provision is made for a lubricant supply system which receives lubricant from the lubricant oil sump 56 that is subjected to a high pressure and supplies it to a filter unit 102 and then supplies the lubricant to the individual bearing units 62, 64, 72, 74 from the filter unit 102.

In particular, the lubricant supply system comprises a lubricant distribution system 104 which leads from the filter unit 102 to the bearing units 62, 64.

In order to enable the bearing units 62, 64 to be optimally lubricated by the lubricant distribution system 104, the roller bearings 112, 114 accommodating the bearing shaft sections 66, 68 in rotary manner are each arranged in bearing housings 116, 118 that are formed on the one hand by wall areas 132, 134 of the compressor housing 12 which accommodate outer bearing races 122, 124 of the roller bearings 112, 114 and are provided with seating borings 126, 128 and are closed on the side remote from the respective screw rotors 26, 28 by bearing housing covers 136, 138 so that lubricant chambers 142, 144 are formed in the bearing housings 116, 118 to which the lubricant for lubricating the roller bearings 112, 114 is to be supplied.

On the one hand, a sufficient quantity of lubricant has to be supplied to these lubricant chambers 142, 144 in order to ensure reliable and long-term lubrication of the roller bearings 112, 114, but on the other hand, the supply of too much lubricant to the lubricant chambers 142, 144 will lead to churning losses and pinching losses in the region of the roller bearings 112, 114 which will increase the power consumed by the drive motor 84 and thus worsen the performance figures of the refrigerant compressor.

Consequently, it is necessary to ensure that there is a proportioned supply of lubricant from the lubricant distribution system 104. To this end, each of the bearing housings 116, 118 is provided with a lubricant dispensing unit 152, 154 which is integrated into the respective bearing housing cover 136, 138 for example.

The function and the operation of the lubricant dispensing units 152, 154 are described exemplarily hereinafter on the basis of the lubricant dispensing unit 154 which is integrated into the bearing housing cover 138, whereby corresponding remarks apply for the lubricant dispensing unit 152 integrated into the bearing housing cover 136.

Figure 3:
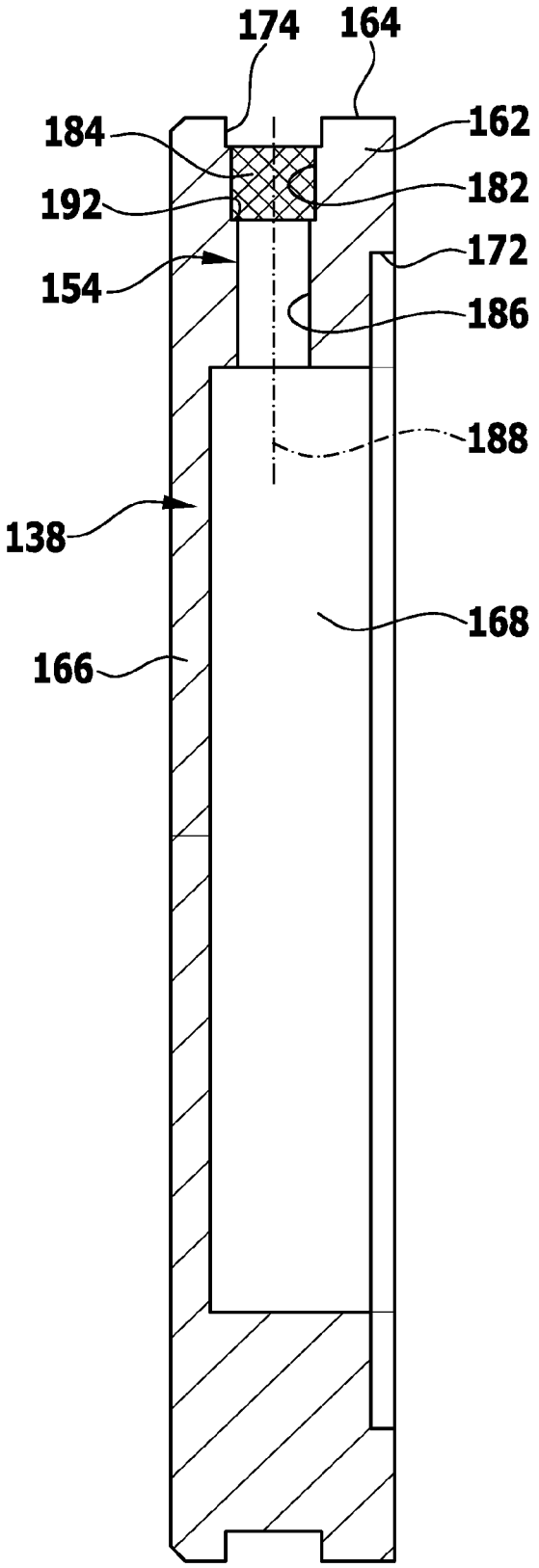
FIG. 3 an enlarged section through a first exemplary embodiment of a bearing housing cover in accordance with the invention.

As illustrated in FIG. 3, the bearing housing cover 138 comprises an outer annular body 162 having a radially outermost peripheral surface 164 which is inserted into the corresponding seating boring, in this case, the seating boring 128. A closure wall designated by the general reference 166 is formed on the annular body 162, said wall bounding an inner space 168 surrounded by the annular body 162 at the side remote from the respective screw rotor 26, 28, whilst the inner space 168 comprises an opening 172 facing towards the respective roller bearing, in this case the roller bearing 114, so that the corresponding lubricant chamber 144 can extend into the inner space 168.

Furthermore, the annular body 162 comprises a peripheral groove 174 which extends into the body from the peripheral surface 164 and also serves to convey the lubricant being supplied from the lubricant distribution system 104 to the bearing housing cover 138 for example.

In the first exemplary embodiment illustrated in FIG. 3, the lubricant dispensing unit 154 comprises a filter holding chamber 182 which extends from the groove 174 into the annular body 162 and into which a filter body 184 is inserted.

An inlet channel 186 extends into the inner space 168 from the filter holding chamber 182 and is preferably coaxial therewith.

Here for example, the filter holding chamber 182 and also the inlet channel 186 are implemented as borings wherein, with reference to a central axis 188, the filter holding chamber 182 is of greater diameter than the inlet channel 186 which adjoins it coaxially, so that a step 192 upon which the filter body 184 abuts is formed at the point of transition from the filter holding chamber 182 to the inlet channel 186 and this step prevents the filter body 184 from migrating into the inner space 168.

The filter body 184 is preferably made of a porous material so that, by appropriate selection of the porosity thereof, the filter body 184 is effective as a flow control for the supplied lubricant and it is thus in a position to restrict the supply of lubricant to the corresponding lubricant chamber 144 in such a way that sufficient lubricant, but not too much lubricant, is supplied to the respective lubricant chamber, in this case, the lubricant chamber 144.

The filter body 184 can be constructed from various materials.

One possibility envisages that the filter body 184 be formed of a sintered metal whereby bronze or stainless steel can be used as the material.

Another possibility envisages that the filter body 184 be formed of a refrigerant-neutral and lubricant-neutral synthetic material whereby in particular, a sintered porous synthetic material and/or a compacted baked synthetic material granulate can be used.

In the first exemplary embodiment of the lubricant dispensing unit 154 in accordance with the invention, the inlet channel 186 adjoining the filter holding chamber 182 does not work here as a flow obstructing means, but rather, it is irrelevant to the question of proportioning the amount of lubricant being supplied to the lubricant chamber 144.

For example, the lubricant then collects at least partially in the lubricant chamber 144 in the form of a lubricant bath 190 at the deepest point in the direction of the force of gravity, and from there, it passes on into the roller bearing 114.

Figure 4:
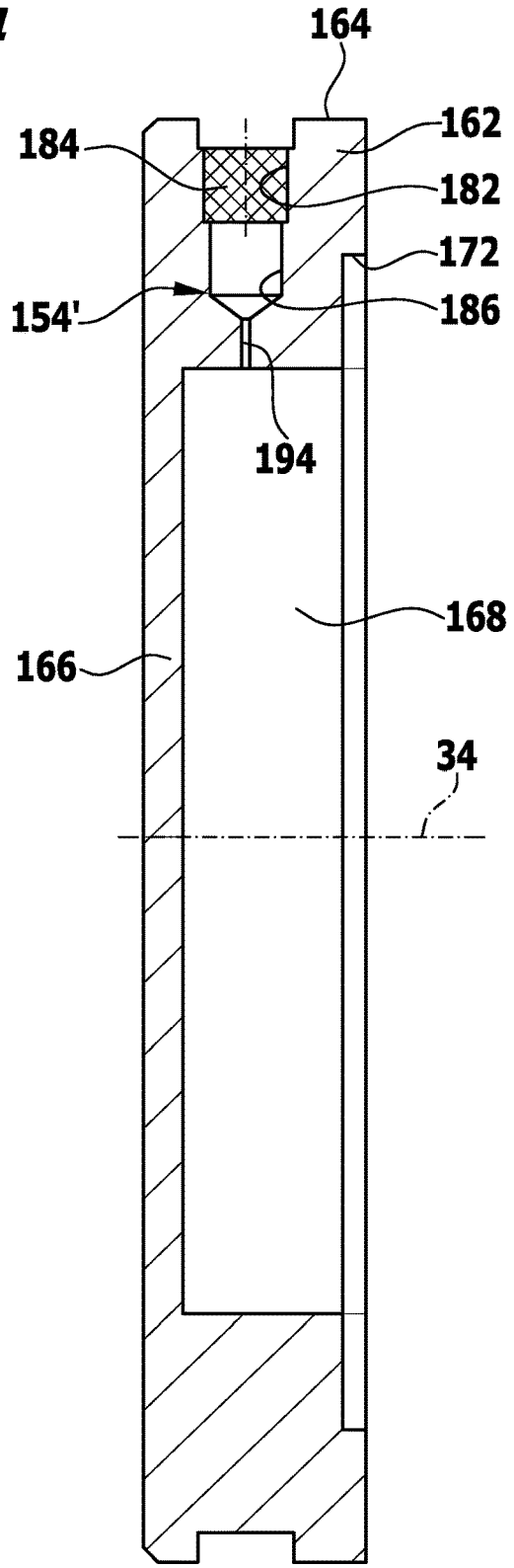
FIG. 4 a section similar to FIG. 3 through a second exemplary embodiment of a bearing housing cover in accordance with the invention.

In a second exemplary embodiment of a lubricant dispensing unit 154' in accordance with the invention which is illustrated in FIG. 4, the inlet channel 186 adjoining the filter holding chamber 182 does not open out directly into the inner space 168 of the annular body 162, but rather, it merges into a throttle boring 194 which has a restriction effect on the stream of lubricant being supplied that is additional to that produced by the filter body 184 so that in this case, the lubricant dispensing unit 154' exercises a restriction effect by means of the filter body 184 on the one hand and by means of the throttle boring 194 on the other, whereby the throttle boring 194 is preferably aligned radially with respect to the rotational axis 34 of the corresponding roller bearing, the roller bearing 114 in this case.

Figure 5:
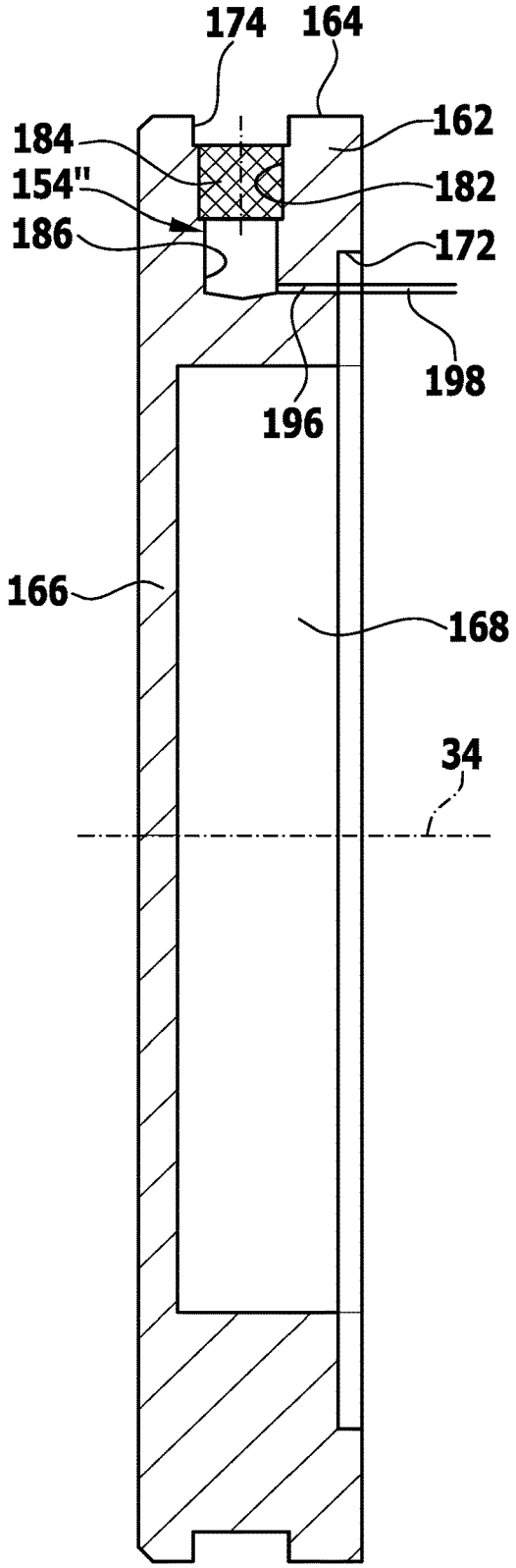
FIG. 5 a section through a third exemplary embodiment of a bearing housing cover in accordance with the invention.

In a third exemplary embodiment of a lubricant dispensing unit 154" in accordance with the invention which is illustrated in FIG. 5, the inlet channel 186 running radially with respect to the rotational axis 34 of the associated roller bearing 114 merges into a nozzle boring 196 which lies within the opening 172 of the inner space 186 facing the roller bearing 114, although it extends especially parallel or slightly inclined to the rotational axis 34 of the associated roller bearing 114 and thus produces a jet of lubricant 198 that is directed directly onto the roller bearing 114 and in particular onto the rolling members thereof so that a direct supply of lubricant to the roller bearing 114 is produced in order to optimize the distribution of lubricant in the roller bearing 114.

In this case for example, the inlet channel 186 is closed with respect to the inner space 168 of the annular body 162.

Figure 6:
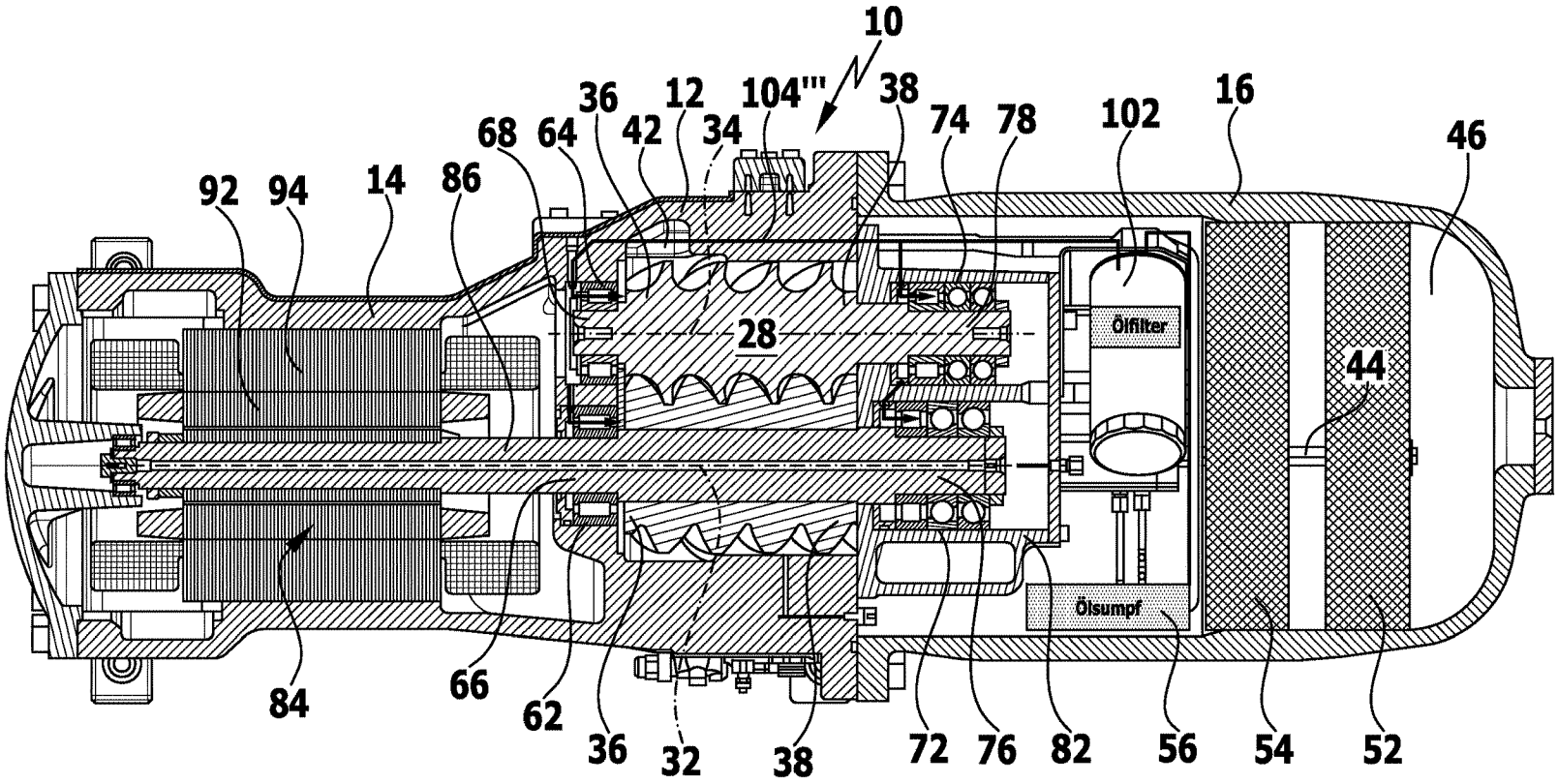
FIG. 6 a schematic longitudinal section similar to FIG. 1 through a second exemplary embodiment of a refrigerant compressor in accordance with the invention.

In a second exemplary embodiment of a rotary screw compressor in accordance with the invention which is illustrated in FIG. 6, all of those parts that are identical to those of the first exemplary embodiment are provided with the same reference symbols so that in regard to the description thereof, reference may be made to the detailed explanations given for the first exemplary embodiment.

In contrast to the first exemplary embodiment, the lubricant distribution system 104'" not only supplies the bearing units 62 and 64 but also the bearing units 72 and 74 with lubricant.

Figure 7:
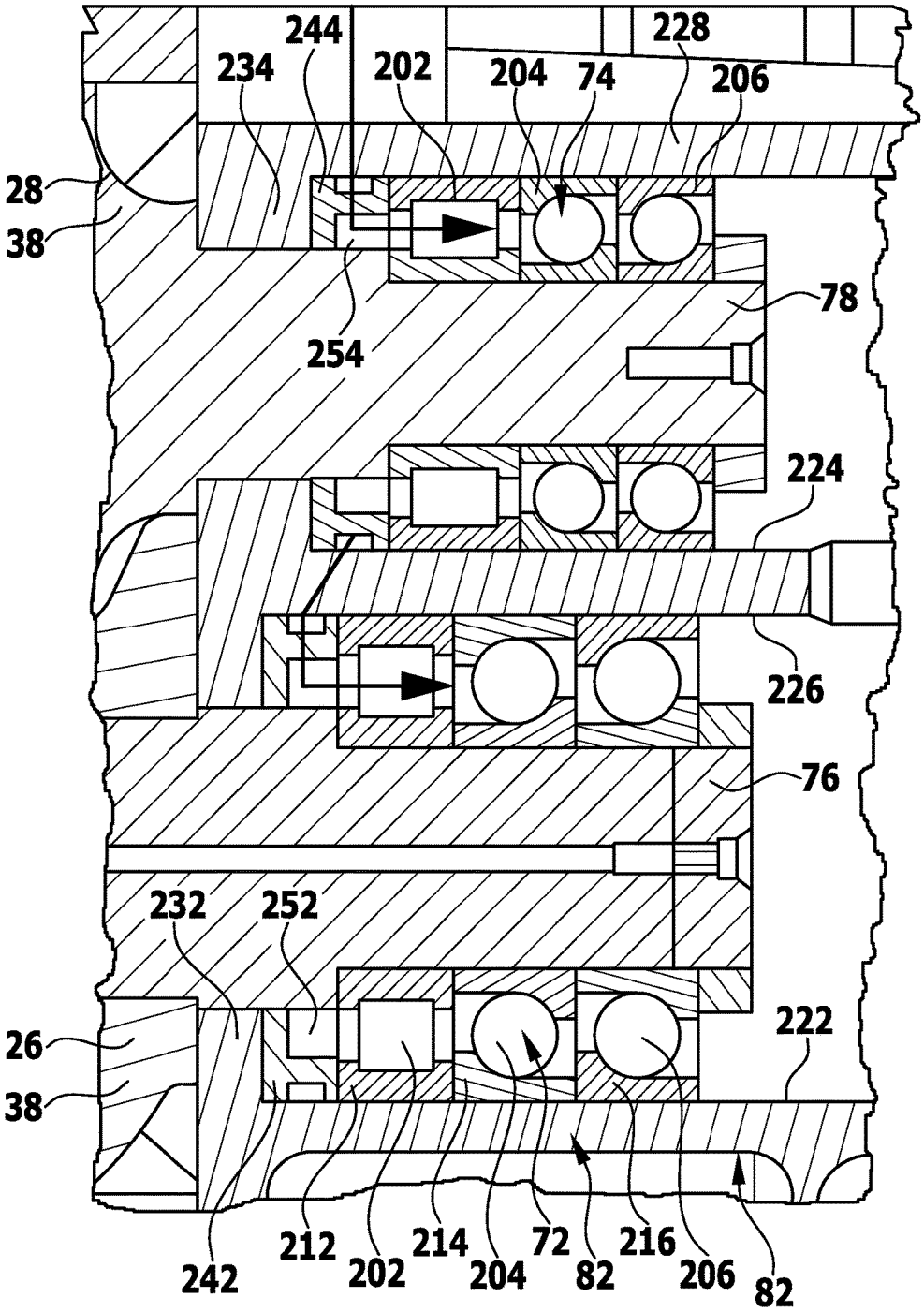
FIG. 7 an enlarged sectional view corresponding to FIG. 6 in the region of bearing units arranged at the high pressure side.

As illustrated in FIG. 6 and enlarged in FIG. 7, each of the bearing units 72 and 74 comprises a set of roller bearings 202, 204 and 206 which are arranged at the high pressure sides of the bearing housings that are designated as a whole by 82 and their outer bearing races 212, 214, 216 are seated in seating borings 222 and 224 of the bearing housing 82 that are provided therefor, wherein the seating borings 222, 224 are surrounded by wall regions 226, 228 of the high pressure side bearing housing 82 and moreover, are bounded on the sides thereof facing the high pressure sides 38 of the screw rotors 26, 28 by wall regions 232, 234 which are penetrated by the shaft sections 76 and 78 against which they are a tight fit so that the wall regions 232, 234 form a sealed termination between the high pressure sides of the screw rotors 26, 28 and the seating borings 222, 224.

On the sides of the wall regions 232, 234 opposite the high pressure sides 38 of the screw rotors 26, 28, there are bearing housing rings 242, 244 which are inserted into the seating borings 222, 224 and are thus arranged between the respective wall regions 232, 234 and the respectively nearest roller bearing 202.

Bearing housing rings 242, 244 of this type can either be arranged at the ends of the roller bearings 202, 204, 206 as illustrated in FIGS. 6 and 7, or be located between two of the roller bearings 202, 204, 206.

The bearing housing rings 242, 244 bound lubricant chambers 252, 254 that are arranged between them and the nearest roller bearings 202, the supply of lubricant to the roller bearings 202, 204 and 206 through the respective bearings for example being effected from said lubricant chambers.

Figure 8:
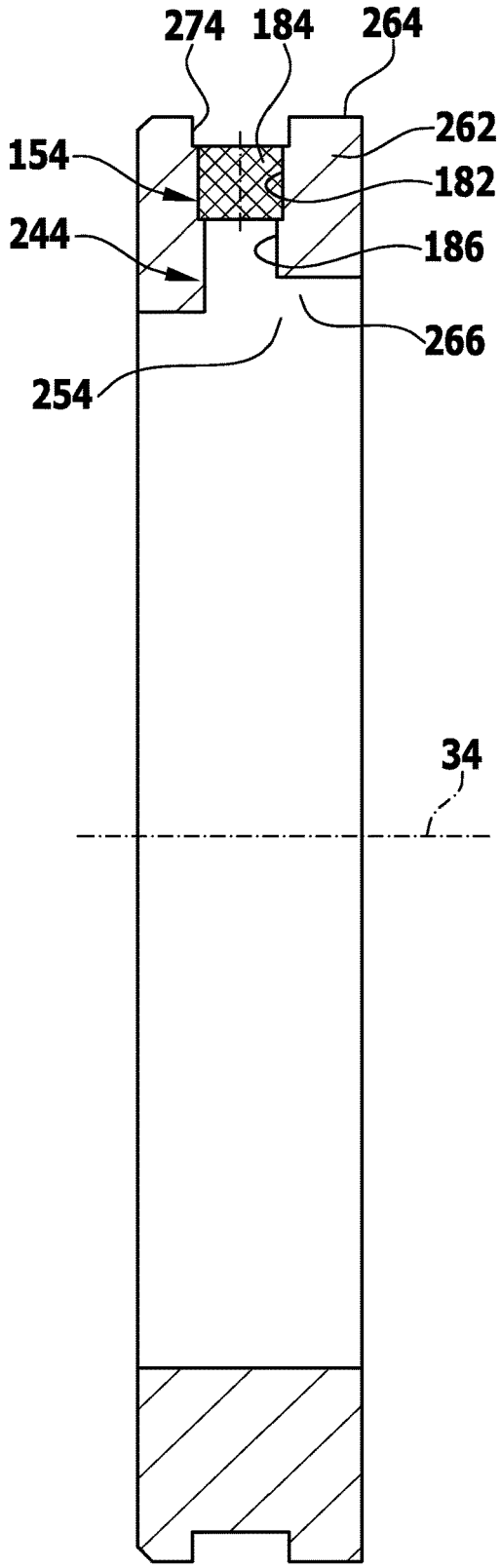
FIG. 8 an enlarged section similar to FIG. 3 through a first exemplary embodiment of a bearing housing ring in accordance with the invention.

As is illustrated in FIG. 8 in the case of a first exemplary embodiment of the bearing housing ring 244, each of these bearing housing rings 242, 244 comprises an annular body 262 having a peripheral surface 264 abutting the wall regions 226, 228 and also an inner space 266 which is located opposite the peripheral surfaces 264 and forms part of the respective lubricant chamber 254.

Furthermore, a groove 274 extends from the peripheral surface 264 into the annular body 262 in the same way as for the bearing housing covers 136, 138.

Furthermore, extending from the groove 274, there is the filter holding chamber 182 with the filter body 184 and an inlet channel 186 which is connected to the filter holding chamber 182 and opens out into the inner space 266 of the bearing housing ring 244.

Commencing from the groove 274 which has the same purpose as was described in connection with the bearing housing covers 136, 138, there is thus likewise provided in each of the bearing housing rings 242, 244 the lubricant dispensing unit 152, 154 which comprises the filter holding chamber 182 that extends from the groove 274 into the annular body 262 and into which the filter body 184 is inserted and then the inlet channel 186 which extends therefrom into the inner space 266 of the bearing housing ring 244.

Here, the lubricant dispensing unit 152, 154 is constructed in the same way as that described in the preceding exemplary embodiments and has the same effect as was likewise explained in connection with these exemplary embodiments.

The bearing housing ring 244 could also be inserted between two of the roller bearings 202, 204, 206.

Figure 9:
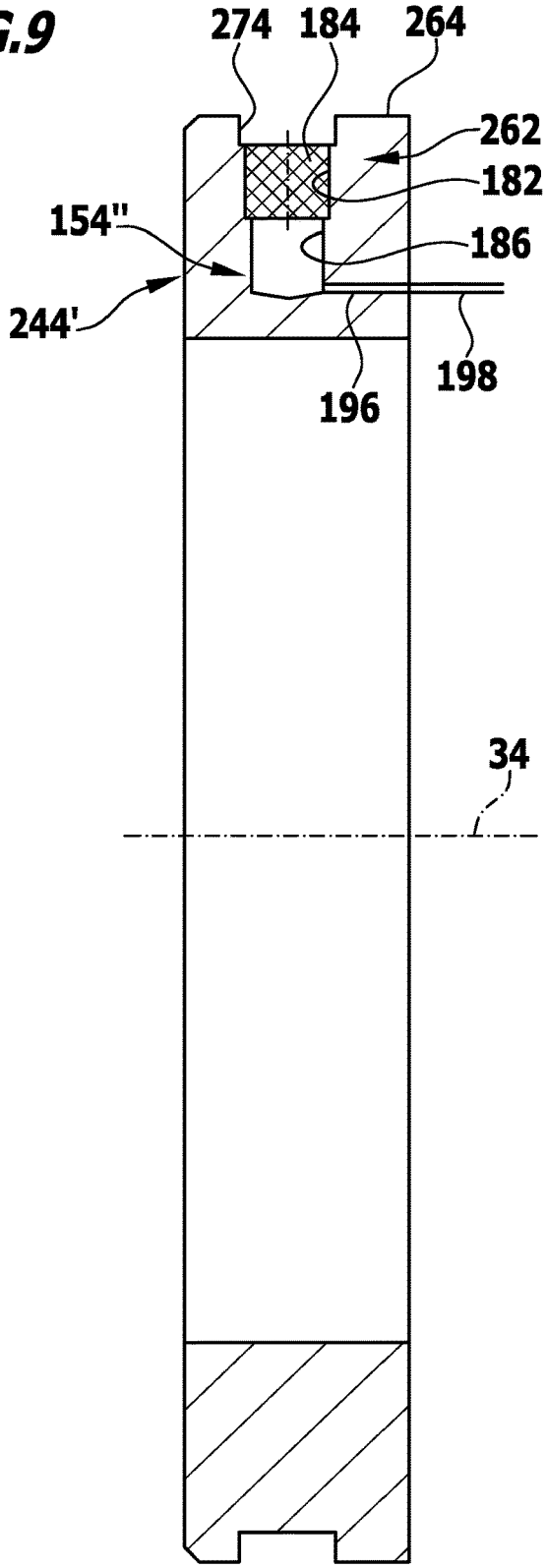
FIG. 9 an enlarged section similar to FIG. 8 through a second exemplary embodiment of a bearing housing ring in accordance with the invention and FIG. 10 a section similar to FIG. 8 through a third exemplary embodiment of a bearing housing ring in accordance with the invention.

In a second exemplary embodiment of the bearing housing ring 244' which is illustrated in FIG. 9, the lubricant dispensing unit 154" is constructed in the same way as was described for the third exemplary embodiment of the bearing housing cover 136, 138 of the first exemplary embodiment of the refrigerant compressor in accordance with the invention so that reference can be made to the detailed description of the third exemplary embodiment, whereby the lubricant dispensing unit 154" is integrated into the annular body 262 in this case and the annular body 262 does not comprise an inner space 266. Instead, the annular body 262 comprises the nozzle boring 196 which is directed toward the first roller bearing 202 and extends from the inlet channel 186 into the lubricant chamber 254, said nozzle boring producing the jet of lubricant 198 that is directed onto the rolling members of the first roller bearing 202 in particular.

Figure 10:
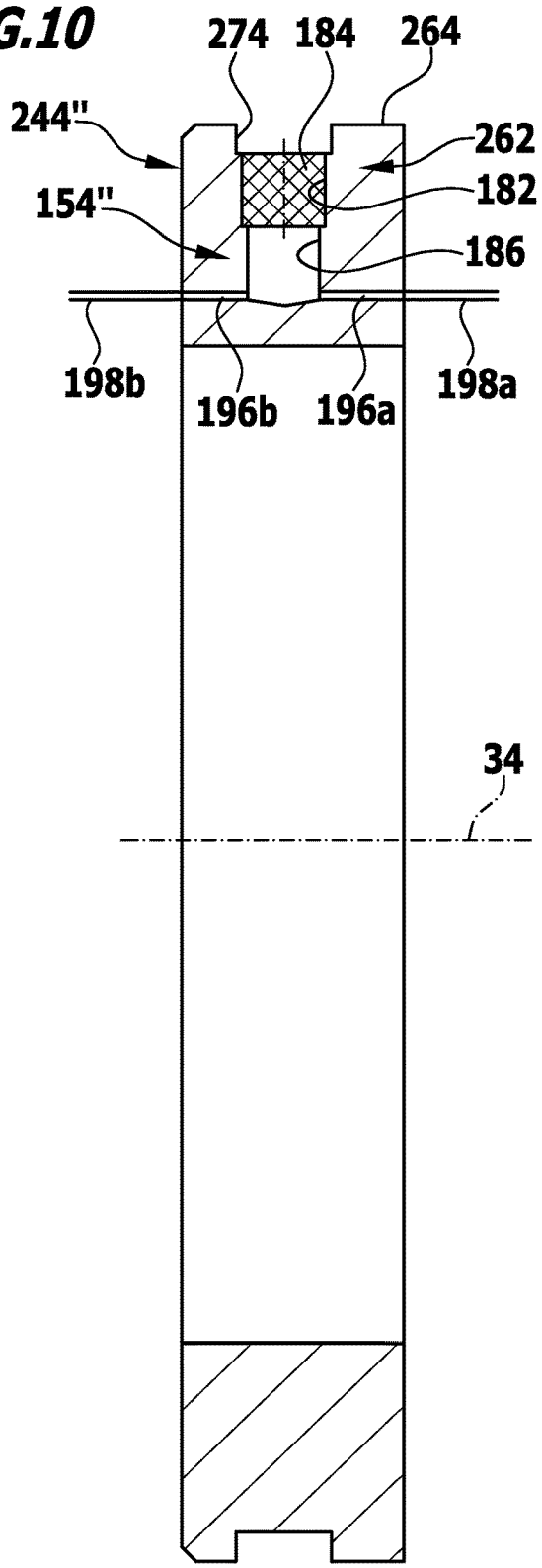

A third exemplary embodiment of a bearing ring 244" in accordance with the invention which is illustrated in FIG. 10 is constructed in such a way that it can preferably be inserted between two of the roller bearings 202, 204, 206, whereby there are provided mutually opposite nozzle borings 196*a, b* which each produce a jet of lubricant 198*a, b* so that the jets of lubricant 198*a, b* propagates in mutually opposite directions.

In all other respects, the third exemplary embodiment is constructed in the same way as the second exemplary embodiment so that reference is made to the details thereof.

The invention claimed is:

1. Refrigerant compressor, in the form of a rotary screw compressor, comprising a compressor housing, at least one compressor element which is arranged in the compressor housing and is driven by a drive, a plurality of bearing units disposed at at least one of a low pressure side or a high pressure side for the at least one compressor element driven by the drive, each of the bearing units comprising a bearing housing and at least one roller bearing that is arranged in the bearing housing, a lubricant being supplied to the bearing housing by a lubricant distribution system, a plurality of lubricant dispensing units, each lubricant dispensing unit comprising a filter holding chamber and a filter body is arranged in the filter holding chamber, wherein the lubricant dispensing units include a first lubricant dispensing unit arranged to dispense lubricant to at least one of the bearing units of the low pressure side or the high pressure side and a second lubricant dispensing unit arranged to dispense to at least another one of the bearing units of the low pressure side or the high pressure side.

2. The refrigerant compressor in accordance with claim 1, wherein each lubricant dispensing unit comprises an inlet channel which extends from the filter holding chamber to a lubricant chamber adjoining the roller bearing.

3. The refrigerant compressor in accordance with claim 1, wherein each lubricant dispensing unit comprises a throttle boring which is arranged between the filter holding chamber and a lubricant chamber adjoining the roller bearing.

4. The refrigerant compressor in accordance with claim 3, wherein each lubricant dispensing unit supplies the lubricant to the lubricant chamber associated therewith.

5. The refrigerant compressor in accordance with claim 1, wherein each of the first and second lubricant dispensing units is integrated into the bearing housing of a respective unit of the first and second bearing units to dispense lubricant thereto.

6. The refrigerant compressor in accordance with claim 1, wherein the bearing housing for each of the first and second bearing units comprises a housing element in which a respective unit of the first and second lubricant dispensing units is arranged.

7. The refrigerant compressor in accordance with claim 6, wherein the housing element is a bearing housing cover of the bearing housing.

8. The refrigerant compressor in accordance with claim 6, wherein the housing element is a bearing housing ring of the bearing housing.

9. The refrigerant compressor in accordance with claim 1, wherein each lubricant dispensing unit is provided with a nozzle boring which is located after the filter holding chamber and produces a jet of lubricant that is directed onto the roller bearing in the bearing housing.

10. The refrigerant compressor in accordance with claim 9, wherein the nozzle boring simultaneously acts as a throttle boring of the respective lubricant dispensing unit.

11. The refrigerant compressor in accordance with claim 1, wherein the refrigerant compressor comprises a plurality of screw rotors.

12. The refrigerant compressor of claim 1, wherein the first lubricant dispensing unit dispenses lubricant only to the first bearing unit, and the second lubricant dispensing unit dispenses lubricant only to the second bearing unit.

13. The refrigerant compressor of claim 1, wherein some of the bearing units are unaffiliated with any of the lubricant dispensing units.

14. The refrigerant compressor of claim 1, wherein each of the bearing units comprises a plurality of bearings arranged side by side.

* * * * *